United States Patent [19]

Rejwan

[11] Patent Number: 4,530,176

[45] Date of Patent: Jul. 23, 1985

[54] APPARATUS FOR CATALOGUING PHOTOGRAPHS AND NEGATIVES

[75] Inventor: Sasson Rejwan, North Woodmere, N.Y.

[73] Assignee: Berkey Photo, Inc., White Plains, N.Y.

[21] Appl. No.: 536,210

[22] Filed: Sep. 27, 1983

[51] Int. Cl.[3] ..... B42F 21/00

[52] U.S. Cl. ..... 40/359; 40/360; 40/159; 312/184

[58] Field of Search ..... 40/152, 152.1, 158, 40/159, 359, 360; 312/184, 183; 282/15 B

[56] References Cited

U.S. PATENT DOCUMENTS

| | | | |
|---|---|---|---|
| 1,034,221 | 7/1912 | Dutton | 281/15 A |
| 3,850,488 | 11/1974 | Elias et al. | 312/184 |
| 3,977,527 | 8/1976 | Rose et al. | 312/184 |

FOREIGN PATENT DOCUMENTS

| | | | |
|---|---|---|---|
| 654515 | 6/1951 | United Kingdom | 312/184 |

*Primary Examiner*—Robert Peshock
*Assistant Examiner*—Wenceslao J. Contreras
*Attorney, Agent, or Firm*—Neuman, Williams, Anderson & Olson

[57] ABSTRACT

An apparatus for cataloguing and storing photographic prints and negatives in the same aesthetically designed case. In one embodiment, a negative album is placed in one compartment of the case, and a second compartment of the case retains a plurality of separately bound and identifiable photograph albums. The negative albums holds a plurality of conventional paper negative/-print wallets, labelled to correspond to respective photograph albums stored in the apparatus. Each individual photograph album is designed for facile addition, removal, substitution and viewing of individual photographs; and is attached to a hand-grippable hanger element to permit both removal of albums from the case as well as their return to the case. The apparatus performs the same function whether vertically or horizontally disposed.

15 Claims, 12 Drawing Figures

FIG. 9
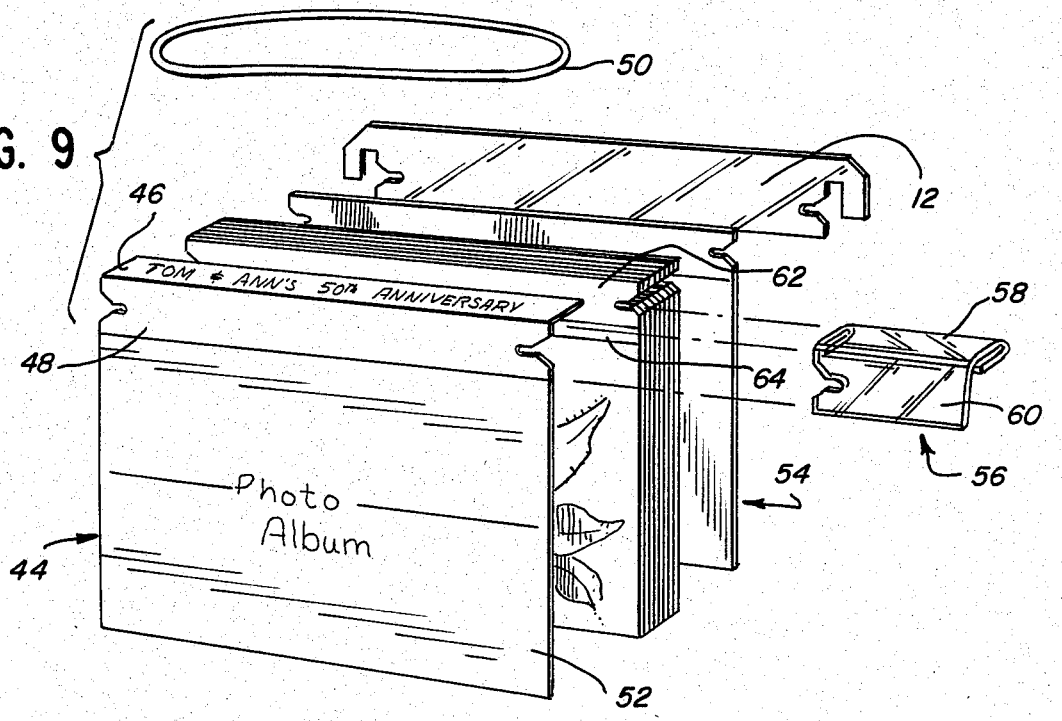
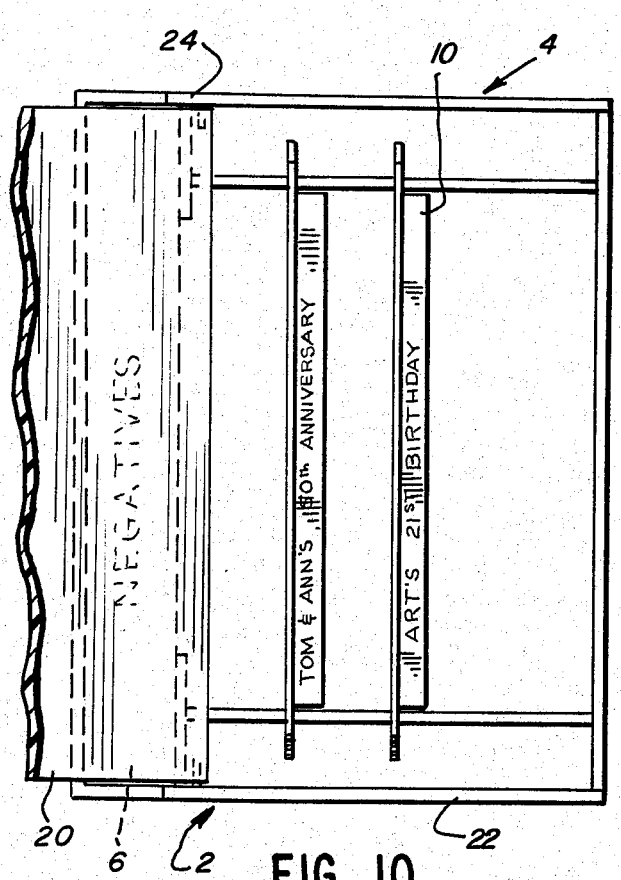
FIG. 10
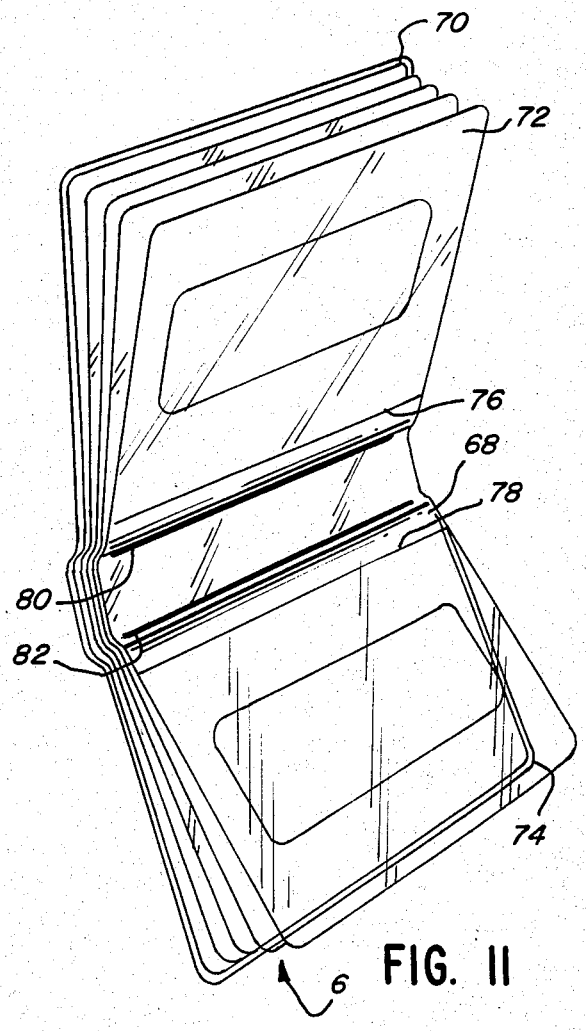
FIG. 11

APPARATUS FOR CATALOGUING PHOTOGRAPHS AND NEGATIVES

BACKGROUND OF THE INVENTION

This invention relates generally to photograph albums. More particularly, it relates to an apparatus for conveniently cataloguing and retrieving photographic prints and negatives. Photographs and negatives are both stored together in an aesthetically designed case, which is conveniently sized to fit on a desk or library shelf.

Heretofore, the common practice has been to arrange and mount photographs on a latex-coated thin cardboard sheet, such sheet constructed with an overlay of a transparent sheet of synthetic resin film material to protect the photographs, and then to place a plurality of such sheets into a conventional ring binder. Other photograph album page structures have been proposed, along the same lines, in an effort to protect photographs from curling, dirt, scratches and so forth. These album page constructions, however, have proven costly to manufacture and less than desirable in important respects; such as the ease of inserting or removing individual photographs, the ease of substituting or changing the order of photographs, the ease of viewing the photographs without glare caused by the film overlays and the facility with which the photographs can be grouped and identified by pen markings.

Also known in common usage, of course, are a variety of desk-top photograph cubes and display apparatus. These devices are intended for the display of a few photographs only; and are not suitable for cataloguing a large quantity of photographs in a compact location.

Wentges U.S. Pat. No. 3,116,738 discloses a book-like photograph album comprised of a plurality of mounting tongues, with photographs adhesively connected thereto. An elastic band holds the mounting tongues together. While the Wentges album facilitates the viewing of individual photographs, it does not provide any means for labelling or otherwise identifying the contents of the photograph album; nor does Wentges disclose any means for storing or cataloguing his photograph albums.

While the aforementioned photograph album devices have been useful, they are not altogether satisfactory. In addition to the foregoing reasons, it is important to note that none of the prior art devices provides a means for storing or cataloguing negatives with the photographs. Thus, they do not address the frequent problem of having to find the negative, corresponding to a photograph in an album, when it is desired to have a duplicate print made of such photograph.

SUMMARY OF THE INVENTION

Accordingly, it is an object of the present invention to provide an improved device for cataloguing and retrieving photographs and negatives, and for storing both a photograph album and a negative album together in an aesthetically designed, conveniently sized and portable case.

It is another object of the present invention to provide an improved photograph album, which facilitates viewing and handling of individual photographs while at the same time providing a novel means for cataloguing and storing such photographs.

It is still a further object of the present invention to provide a negative album, which facilitates the cataloguing and storing of negatives and which may be conveniently stored together with a corresponding set of photographs.

These and other objects of the invention will be apparent hereinafter from the specification which describes the best mode of practicing the invention as currently known, its use and operation, and a preferred embodiment. Reference should also be made to the drawings, which constitute a part of the disclosure, and the subject matter claimed.

Generally, the objects of the present invention are accomplished in an aesthetically designed case, conveniently sized, having a first compartment for receiving a correspondingly shaped negative album and a second compartment fitted with a pair of parallel, spaced support members for receiving a plurality of photograph albums. When the case is horizontally disposed, each photograph album is supported in the second compartment by a hanger member connected to the album, which hanger member rests on the horizontally spaced support members of the compartment; and is readily identifiable from a label, formed at the album's visible edge by the assembly of its first cover leaf and index member elements. As described herein, the case can be rotated 90° about its end to provide a vertically disposed apparatus, having vertically spaced support members, which performs the same function and is used in the same manner.

The negative album of the present invention is shaped in the form of a small notebook. Inside its cover, the negative album contains a plurality of plastic sheets, each sheet forming an envelope with one open edge for receiving a paper negative/print wallet of the type customarily provided by photographic film processors. Negatives are stored within a paper negative/print wallet, which in turn is labelled to correspond to its respective photograph album and placed into a plastic envelope of the negative album for maximum protection and ease of selection.

The photograph album of the present invention is made up of front and rear cover leaves, an index member forming a label at the album's bound edge, a plurality of mounting tongues with photographs respectively adhesively connected thereto and a hanger element, all held together at the top by an elastic band. The photographs are hinged with respect to the mounting tongues near the adhesive connection in order that the photograph album, once removed from its compartment in the case, can be opened to 180°, thereby permitting easy viewing of a selected photograph. The photograph album thus provided permits facile addition, removal or substitution of individual photographs. A white tab portion is provided, integral with the front cover leaf, and a subject and date, for example, may be written thereon. Once the photograph album is assembled, the tab portion appears at the bound edge thereof, identifying the contents of the album.

From the description thus far provided, it is apparent that the proposed device for cataloguing and retrieving photographs and negatives may be used for a variety of photograph storage and display applications.

BRIEF DESCRIPTION OF THE DRAWINGS

For a more complete understanding of this invention, reference should be made to the drawings, as briefly described below:

FIG. 9 is an exploded view of the unassembled parts of the photograph album of FIG. 2, also showing how the index member is superposed over the tab and binding portions of the front cover leaf to form a label at the album's bound edge.

FIG. 10 is a partial front elevation view of an alternative vertical embodiment of the present invention.

FIG. 11 is a perspective view of an opened negative album constructed according to the present invention.

DESCRIPTION OF THE PREFERRED EMBODIMENT

Figure 1:
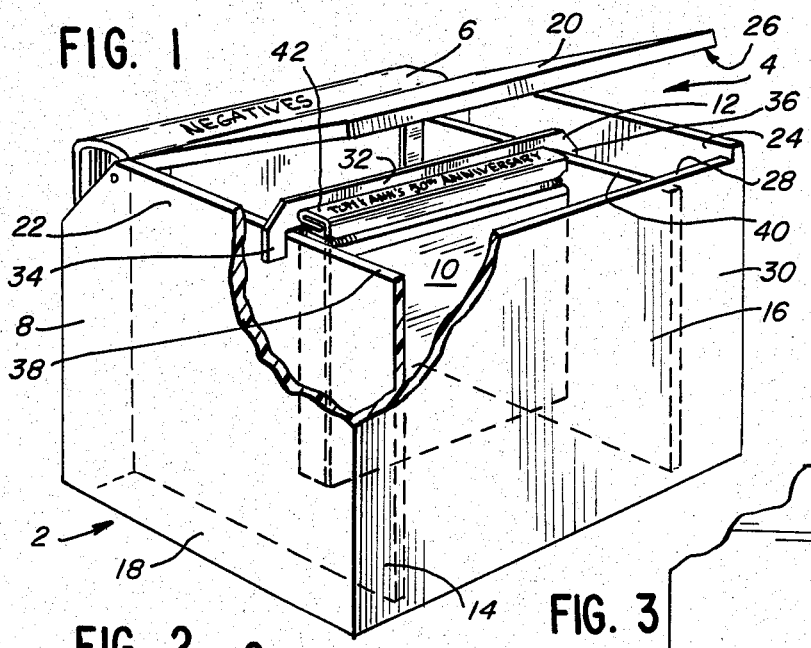
FIG. 1 is a perspective drawing of one embodiment of the present invention showing a negative album in the first compartment of the case, and showing a cutaway view of a photograph album suspended by means of a hanger member on support members formed within the second compartment of the case.

Referring now to FIG. 1, an apparatus 2 is shown for cataloguing and retrieving photographic prints and negatives. The apparatus includes a case or housing 4, a negative album 6 removably positioned in a first compartment 8 of housing 4 and a photograph album 10 which is suspended by hanger member 12 on support members 14 and 16 within a second compartment 18 of housing 4.

Housing 4 is aesthetically designed for placement, for example, on a desk or library shelf. The illustrated design of housing 4 is claimed in applicant's pending U.S. application, Ser. No. 512,040. It will be appreciated however, that it is within the scope of this invention to adopt a variety of housing design configurations. For instance, housing 4 can be variously sized to accommodate different sizes or quantities of photographic prints; or variously shaped to fit in or on different locations. Similarly, housing 4 may be constructed of plastic, glass, wood, cardboard or any other suitable rigid material, to match different environments.

As shown in FIG. 1, a cover lid 20 is provided to keep dust and dirt outside of compartment 18 and/or to conceal the photograph albums therein. In the illustrated embodiment, cover lid 20 is hingedly connected to the insides of sidewalls 22 and 24 at the upper rear corners of compartment 18. In the closed position, the forward edge 26 of the bottom of cover lid 20 rests against the upper edge 28 of the forward wall 30 of housing 4; and the top of cover lid 20 is flush with the top edges of sidewalls 22 and 24. Thus, it can be seen that cases so constructed may be conveniently and securely stacked, one upon the other.

Although only one photograph album 10 is shown in compartment 18 of housing 4, it will be appreciated that a plurality of similar albums may be stored in apparatus 2. When cover lid 20 is opened, a desired photograph album 10 may be removed from compartment 18. It has been found desirable to employ a hanger member 12 with a raised gripping edge 32 to facilitate the removal of photograph album 10 from apparatus 2, as well as the insertion and storage of photograph album 10 therein. A variety of means may be employed to support the hanger member 12 and photograph album 10 connected thereto. In the illustrated and preferred embodiment, the support members 14 and 16 are comprised of parallel, horizontally spaced plates formed within compartment 18. The spacing between the plates 14 and 16 is slightly greater than the width of photograph album 10. In operation, after viewing the photographs in selected photograph album 10, the viewer grabs gripping edge 32 of hanger member 12 and drops the photograph album 10 into compartment 18 of housing 4 such that hanging elements 34 and 36 of hanger member 12 rest upon the upper edges 38 and 40 of support members 14 and 16, respectively.

To facilitate selection of a desired set of photographs, photograph album 10 is fitted with cataloguing means in the form of an index tab 42 at its bound edge. Each photograph album has its own index tab to identify its contents. The unique construction of photograph album 10 is described hereinafter.

Advantageously, a set of negatives, corresponding to the photographs of a given album, may be conveniently stored and appropriately identified in negative album 6. Thus, the present invention eliminates the well-known problem of having to locate the proper negative when it is desired to obtain a duplicate print of a particular photograph.

Figure 2A:
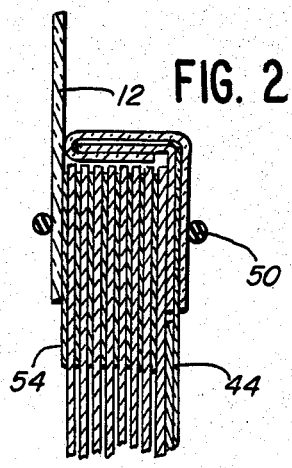
FIG. 2*a* is an enlarged partial sectional view of the photograph album of FIG. 2, taken substantially along the line 2*a*—2*a* of FIG. 2 and showing the elastic band, hanger member, mounting tongues, photographs, index member and cover leaves of a photograph album constructed according to the present invention.
Figure 2:
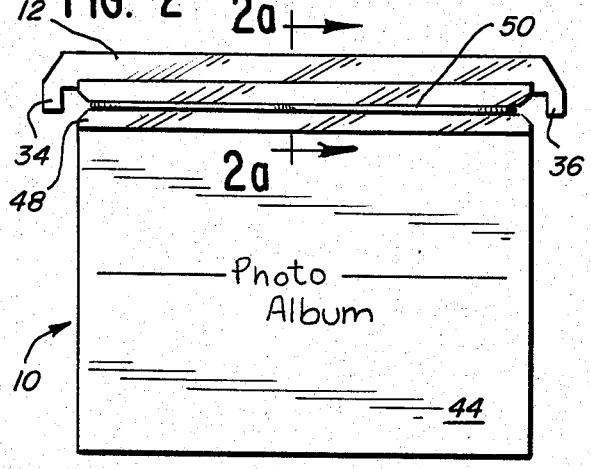
FIG. 2 is a front elevation view of a photograph album connected to a hanger member according to the present invention.
Figure 3:
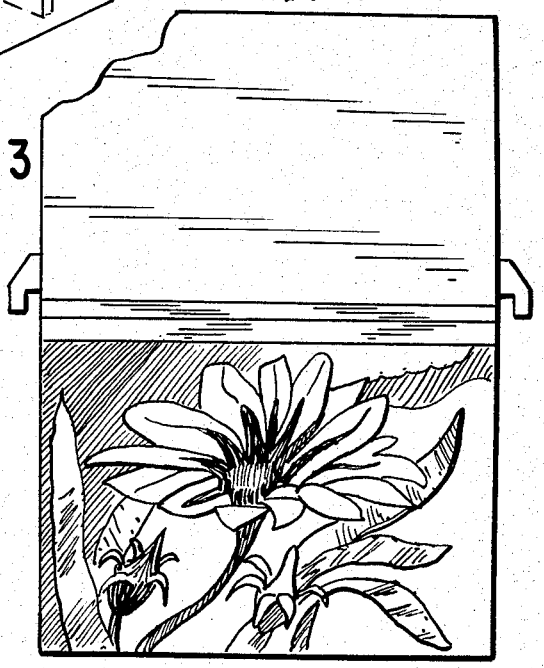
FIG. 3 is a view of the photograph album of FIG. 2, shown opened 180° to display a selected photograph.

FIGS. 2 and 3 show photograph album 10 in its unopened and opened mode, respectively. For purposes of this discussion, hanger element 12 will be treated as a part of photograph album 10. It should be recognized, however, that alternative means may be employed for positioning photograph album 10 between support members 14 and 16. Reference is made, in this context, to applicant's pending U.S. application, Ser. No. 465,545, on the design of a similar album without a hanger member.

Referring now additionally to FIGS. 4-9, and using like numbers to designate like items to assist in understanding the several views, photograph album 10, with hanger member 12 attached thereto, is seen to be comprised of several individual parts.

Figure 4:
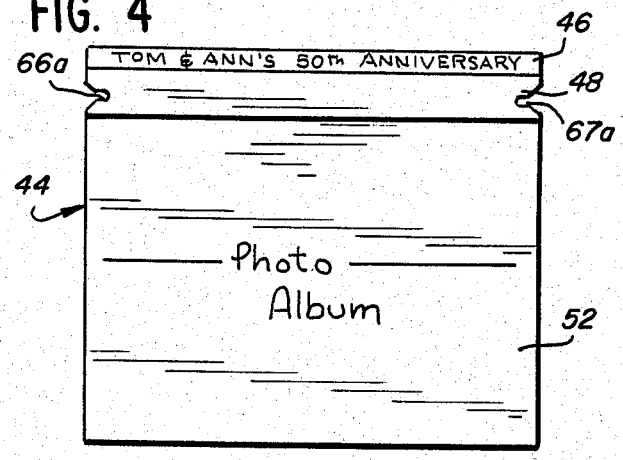
FIG. 4 is a front elevation view of the front cover leaf of the photograph album of FIG. 2, showing the tab, binding and photograph covering portions thereof.
Figure 5:
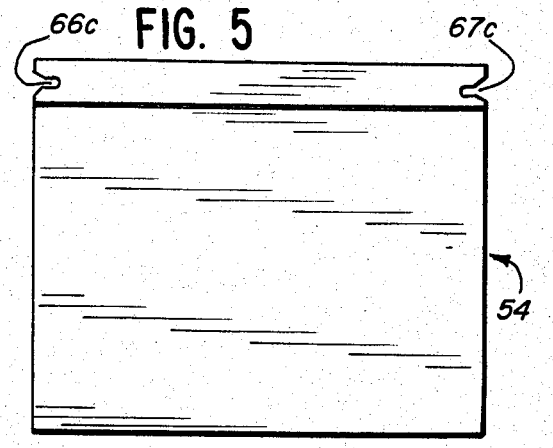
FIG. 5 is a front elevation view of the rear cover leaf of the photograph album of FIG. 2.

The first cover leaf 44 of photograph album 10, shown in FIG. 4, is comprised of three generally rectangular portions. A white strip at the upper edge of cover leaf 44 forms a tab portion 46 upon which album identifying matter may be conveniently written when the album is disassembled. Immediately adjacent to the lower edge of tab portion 46 and foldably connected thereto, being formed from the same continuous sheet of paper stock, is a binding portion 48. It is around binding portion 48 that the entire photograph album 10 is bound by an elastic band 50. The third portion of first cover leaf 44, the photograph covering portion 52, is hingedly connected to the lower edge of binding portion 48.

In the manufacture of the preferred embodiment, first cover leaf 44 is made from paper stock having a gauge thickness of about 10 mil and all of its three portions, 46, 48 and 52, are in one piece. The photograph covering portion 52 and binding portion 48 may be printed or colored as desired. However, the tab portion 46 must remain white to facilitate visibility and clarity of identifying material written thereon. Initially, a cut is made between photograph covering portion 52 and binding portion 48, separating them to facilitate creation of a hinge connection therebetween, as discussed below. A score is made at the rear face of first cover leaf 44 between tab portion 46 and binding portion 58. The score is made to allow tab portion 46 to fold with respect to the binding portion 58. The two pieces are joined, and the hinged connection between binding portion 48 and photograph covering portion 52 thereby formed, by application of a laminate material over the photograph covering portion 52 and the binding portion 48. The laminate material must not cover the tab portion 46, so as to permit writing thereon. Lamination with commonly available adhesive materials has been found to serve a dual function in that a protective plastic coating of approximately 2 mil thickness is applied to the outer face of cover leaf 44, excluding tab portion 46, and the required hinged connection is readily formed between binding portion 48 and photograph covering portion 52. It has been observed, in this operation, that the hinge thickness should be maintained at a minimum, not to exceed about 1/64 of an inch, in order to prevent the adhesive laminate from sticking to itself or sticking to the next page or photographic print when the album is assembled. It has also been observed that application of a laminate layer to the rear face of first cover leaf 44, excluding the hinge gap, can prevent curling of the paper caused by different rates of thermal expansion for the joined paper and plastic layers. No such second laminate layer is required for the rear faces of the binding portion 48 or the tab portion 46 since these two portions are prevented from curling by the index member described below.

A second cover leaf 54 is similarly formed, but without a tab portion. Once assembled, cover leaf 44 becomes the front cover of photograph album 10 and cover leaf 54 becomes the rear cover.

Figure 6:
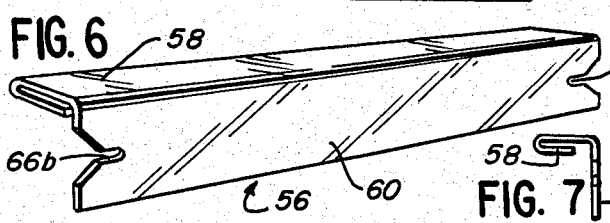
FIG. 6 is a perspective view of the index member of the photograph album of FIG. 2.
Figure 7:
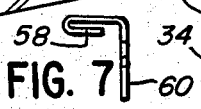
FIG. 7 is an end view of the index member of the photograph album of FIG. 2.

As best seen in FIG. 9, index tab 42 is formed from the combination of tab portion 46 of first cover leaf 44 and index member 56, shown in FIGS. 6–7. Index member 56 is a rigid plastic piece, having a substantially L-shaped cross-section and a length generally equal to the width of photograph album 10. Index member 56 has a horizontal channel-shaped leg 58 and a vertical leg 60. Index tab 42 is formed, during the assembly of photograph album 10, by superposing leg 58 over tab portion 46 and leg 60 over binding portion 48 so as to bend tab portion 46 90° with respect to binding portion 48. In this manner, tab portion 46, upon assembly of photograph album 10, closes off the bound edge thereof and serves as a label therefor. Moreover, index member 46 serves to protect and preserve the written material on tab portion 46, and it further keeps photograph album 10 from bending about its vertical axis.

Disposed between cover leaves 44 and 54 in photograph album 10 are a plurality of generally rectangular mounting tongues and photographic prints respectively connected thereto. Each mounting tongue is comprised of a paper portion 62, correspondingly shaped to the binding portion 48 of first cover leaf 44, and an adhesive portion to which a photograph may be attached. The adhesive portion of each mounting tounge comprises an adhesive tape applied to the rear face of paper portion 62. To insure a uniform thickness of several mounting tongues, the tape should cover the entire rear face of paper portion 62. The photograph is attached to an approximately ⅛ inch wide connecting strip at the lower edge of the adhesive portion. Between the lower edge of paper portion 62 and said photograph connecting strip of said adhesive portion, a thin strip of plastic material is applied to form a non-adhesive hinge 64. It has been found that a hinge thickness of approximately 3/16 inch permits each photograph, in a stack of mounted photographs, to fold open 180° with respect to a consecutive photograph. A sample mounting tongue, having a paper portion 62 and an adhesive hinge 64, is shown in FIG. 9. In its commercial usage, photograph album 10 can be sold in assembled or kit form. In the former case, customers would have a photographic film processor prepare an album of selected prints. In the latter case, purchasers could buy the mounting tongues and album components separately, and affix selected photographs to the mounting tongues before assembly; they could buy mounting tongues alone and supplement pre-assembled albums; or they could purchase the cover leaves and split existing albums.

Figure 8:
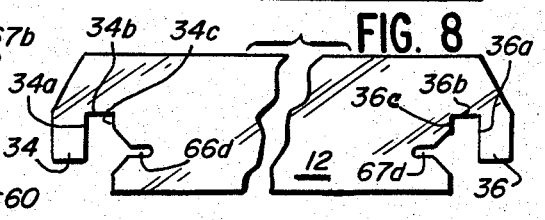
FIG. 8 is a partial enlarged view of the hanger member of the photograph album of FIG. 2.

The next element of the photograph album, depicted in FIGS. 2–9, is the hanger member 12 shown in FIG. 8 with hanging elements 34 and 36. Hanging element 34 has inside edges **34*a*, 34*b* and 34*c*, shaped to engage with support member 14. Hanging element 36 has inside edges 36*a*, 36*b* and 36*c*, shaped to engage with support member 16. The spacing between support members 14 and 16 is slightly greater than the width of photograph album 10 and slightly less than the distance between the inside vertical edges 34*a* and 36*a*. This spacing permits easy movement of photograph album 10 into and out of compartment 18 of housing 10, while at the same time preventing tilting of photograph album 10 or its swinging off support members 14 and 16 when housing 4** is used in a vertical position.

To facilitate the assembly of the aforelisted parts of photograph album 10, all of the parts are formed with first and second identations at their respective ends, which indentations are in substantial registration with the indentations of contiguous parts. Thus, binding portion 48 of first cover leaf 44 has indentations **66*a* and 67*a*; index member 56 has indentations 66*b* and 67*b*; the binding portion of second cover leaf 54 has indentations 66*c* and 67*c*; hanger member 12 has indentations 66*d* and 67*d*; and the mounting tongues have complemental indentations. As shown in FIG. 9, photograph album 10 is assembled by lining up the respective parts and binding them together by placing elastic band 50** around the parts and into the groove formed by the aligned indentations therein.

The photograph album, thus formed according to the present invention, may then be stored and catalogued in housing 4. Additionally, the disclosed photograph album offers other important advantages. Because the photograph album assembly is readily taken apart and put back together again, individual photographs may be easily substituted, added or removed. An even greater advantage is the ease with which individual photographs may be viewed in an album such as the one claimed and described herein. Holding the bound edge of a photograph album constructed according to the present invention, the viewer can open the album at any point to view a selected photograph, without touching the photograph itself and without the annoying glare of a plastic overlay. This advantage obtains from the hinge 64 formed on the adhesive portion between the mounting tongue paper portion and the photograph connecting edge. The photograph album is compact and portable. Of course, the photograph album described herein has its own built-in label to identify its contents.

FIG. 10 shows an alternative use of apparatus 2; it illustrates the fact that housing 4 may be stood upright on sidewall 22 to provide a vertical case, without detracting from the operation of the present invention. Since housing 4 has no protruding edges, it can be conveniently and securely stacked, either horizontally or vertically.

FIG. 11 shows the embodiment of a negative album binder 6. The illustrated notebook is constructed of a stack of plastic sheets. Each sheet 68 has a rectangular shape conforming to the shape of album cover 70. Additionally, each sheet has two pockets 72 and 74 formed at opposite ends of the upper face of sheet 68. The open mouth ends 76 and 78 of pockets 72 and 74, respectively, are conveniently sized to receive paper negative/print wallets of the type customarily provided by photographic film processors. Negatives may be stored in the paper wallets for maximum protection; and the wallets may be stored in the negative album plastic envelopes for ease of access. In the preferred embodiment, plastic sheets 68 are heat-welded, at lines 80 and 82, to each other and to album cover 70. Negative wallets may be labelled, prior to insertion into the plastic envelopes therefor, to correspond to labelled photograph albums separately stored in compartment 18 of apparatus 2.

In combination, the above described case and albums cooperate to provide a decorative and highly useful apparatus for conveniently cataloguing and retrieving photographic prints and negatives. It is believed that the embodiments herein illustrated and described accomplish all of the above enumerated objects and have made apparent a number of modifications which can be made in the invention disclosed by those having the benefit of the foregoing teachings without departing from the spirit and scope of these principles. Accordingly, it is intended that this invention be limited only by the scope of the appended claims.

What is claimed is:

1. An apparatus for cataloguing and retrieving photographs and negatives comprising:

a rigid housing having first and second compartments, said first compartment formed to receive a correspondingly shaped negative album and said second compartment having a pair of parallel, horizontally spaced support members adapted to receive the ends of a hanger member;

a negative album removably positioned in said first compartment;

at least one photograph album removably positioned in between said pair of parallel, horizontally spaced support members; and a hanger member connected to such photograph album, with the ends of said hanger member engaging said pair of parallel, horizontally spaced support members, whereby said photograph album can be suspended in said second compartment.

2. The apparatus of claim 1 wherein said negative album comprises a notebook having a plurality of leaves formed of plastic material with pockets therein, respectively, for receiving conventional paper negative/print wallets.

3. The apparatus of claim 1 wherein said photograph album comprises:

a first cover leaf having a generally rectangular tab portion at its uppermost transverse edge extending generally the full length thereof, a generally rectangular binding portion foldably connected to and generally coextensive with the lower transverse edge of said tab portion and a generally rectangular photograph covering portion coextensive with and hingedly connected to the lower transverse edge of said binding portion, said binding portion having first and second indentations at the opposite free ends thereof;

a cataloguing means comprising, in combination, said tab portion of said first cover leaf and an index member, said index member causing said first cover leaf tab portion to fold at a generally right angle with respect to said first cover leaf binding portion, whereby an index label is provided along the bound edge of said photograph album;

a stack of generally rectangular photograph mounting tongues, each mounting tongue having first and second indentations at the opposite free ends thereof, said indentations being in substantial registration with the indentations in respectively contiguous mounting tongues in the stack and with the indentations in said binding portion of said first cover leaf;

a second cover leaf having a generally rectangular binding portion at its uppermost transverse edge extending generally the full length thereof and a generally rectangular photograph covering portion coextensive with and hingedly connected to the lower transverse edge of said binding portion, said binding portion having first and second indentations at the opposite free ends thereof and in substantial registration with the indentations in said stack of mounting tongues and said first cover leaf binding portion; and a flexible binding member fitting into said indentations and around said first cover leaf, index member, stack of mounting tongues and second cover leaf for binding said mounting tongues so as to form said photograph album.

4. The apparatus of claim 3 wherein said index member is transparent, thereby forming a protective covering through which identifying material written on said first cover leaf tab portion can be seen.

5. The apparatus of claim 3 wherein said index member comprises a rigid plastic piece of substantially L-shaped cross-section extending generally the length of said first cover leaf uppermost edge and having a vertical leg correspondingly shaped to said first cover leaf binding portion and a horizontal channel-shaped leg adapted to be slidably superposed over said first cover leaf tab portion, said vertical leg having first and second indentations at the opposite ends thereof and in registration with said first and second indentations, respectively, of said first cover leaf binding portion.

6. The apparatus of claim 3 further comprising a plurality of photographic prints respectively connected with said photograph mounting tongues.

7. A photograph album comprising:

a first cover leaf having a generally rectangular tab portion at its uppermost transverse edge extending generally the full length thereof, a generally rectangular binding portion foldably connected to and generally coextensive with the lower transverse edge of said tab portion and a generally rectangular photograph covering portion coextensive with and hingedly connected to the lower transverse edge of said binding portion, said binding portion having first and second indentations at the opposite free ends thereof;

a cataloguing means comprising, in combination, said tab portion of said first cover leaf and an index member, said index member causing said first cover leaf tab portion to fold at a generally right angle with respect to said first cover leaf binding portion, whereby an index label is provided along the bound edge of said photograph album;

a stack of generally rectangular photograph mounting tongues, each mounting tongue having first and second indentations at the opposite free ends thereof, said indentations being in substantial registration with the indentations in respectively contiguous mounting tongues in the stack and with the indentations in said binding portion of said first cover leaf;

a second cover leaf having a generally rectangular binding portion at its uppermost transverse edge extending generally the full length thereof and a generally rectangular photograph covering portion coextensive with and hingedly connected to the lower transverse edge of said binding portion, said binding portion having first and second indentations at the opposite free ends thereof and in substantial registration with the indentations in said stack of mounting tongues and said first cover leaf binding portion; and a flexible binding member fitting into said indentations and around said first cover leaf, index member, stack of mounting tongues and second cover leaf for binding said mounting tongues so as to form said photograph album.

8. The photograph album of claim 7 wherein said index member is transparent, thereby forming a protective covering through which identifying material written on said first cover leaf tab portion can be seen.

9. The photograph album of claim 7 wherein said index member comprises a rigid plastic piece of substantially L-shaped cross-section extending generally the length of said first cover leaf uppermost edge and having a vertical leg correspondingly shaped to said first cover leaf binding portion and a horizontal channel-shaped leg adapted to be slidably superposed over said first cover leaf tab portion, said vertical leg having first and second indentations at the opposite ends thereof and in registration with said first and second indentations, respectively, of said first cover leaf binding portion.

10. The photograph album of claim 7 further comprising a plurality of photographic prints respectively connected with said photograph mounting tongues.

11. The photograph album of claim 7 further comprising a hanger member, also secured by said flexible binding member, for suspending said photograph album from hanger member support elements.

12. The photograph album of claim 11 wherein said hanger member comprises a plastic strip coplanar and contiguous with the back face of said second cover leaf binding portion, said plastic strip having first and second indentations, at the opposite ends thereof and in substantial registration with the indentations in said cover leaf binding portion, and hanging elements extending from each end of said plastic strip to engage photograph album support elements.

13. The photograph album of claims 11 or 12 wherein said hanger member includes a raised gripping portion to facilitate carrying of said photograph album and its removal from or insertion into a storage case.

14. The photograph album of claim 11 wherein said hanger member comprises:

a substantially flat strip of rigid material which is coplanar and contiguous with the back face of said second cover leaf binding portion;

first and second hanging ears extending, respectively, from the first and second ends of said hanger member and formed to define downwardly disposed inner walls for engaging the correspondingly-shaped upper ends of support members;

first and second identations at the opposite ends of said flat strip and in substantial registration with the indentations in said cover leaf binding portion; and a gripping portion connected to the upper edge of said flat strip to facilitate carrying of said photograph album and its removal from or insertion into a storage case.

15. An apparatus for cataloguing and retrieving photographs and negatives according to claim 1 and comprising a rigid housing having first and second compartments, said first compartment formed to receive correspondingly shaped negative album and said second compartment formed to receive at least one photograph album and further comprising means to enclose said second compartment.

* * * * *

UNITED STATES PATENT AND TRADEMARK OFFICE

CERTIFICATE OF CORRECTION

PATENT NO. : 4,530,176

DATED : July 23, 1985

INVENTOR(S) : SASSON REJWAN

It is certified that error appears in the above-identified patent and that said Letters Patent is hereby corrected as shown below:

Abstract, line 7, "albums" should read --album--.
Column 6, line 4, "tounge" should read --tongue--.
Column 6, line 46, "identations" should read --indentations--.
Column 10, line 37, "identations" should read --indentations--.

Signed and Sealed this

*Fifteenth* Day of *October 1985*

[SEAL]

*Attest:*

DONALD J. QUIGG

*Attesting Officer*

*Commissioner of Patents and Trademarks—Designate*